US008651783B2

(12) United States Patent
Grainger

(10) Patent No.: US 8,651,783 B2
(45) Date of Patent: Feb. 18, 2014

(54) STORAGE AND TRANSPORTATION SYSTEM AND ELEMENTS THEREOF

(76) Inventor: Allan Grainger, South Glamorgan (GB)

( * ) Notice: Subject to any disclaimer, the term of this patent is extended or adjusted under 35 U.S.C. 154(b) by 37 days.

(21) Appl. No.: 13/379,366

(22) PCT Filed: Apr. 29, 2010

(86) PCT No.: PCT/GB2010/050702

§ 371 (c)(1),
(2), (4) Date: Mar. 13, 2012

(87) PCT Pub. No.: WO2010/149985

PCT Pub. Date: Dec. 29, 2010

(65) Prior Publication Data

US 2012/0163939 A1 Jun. 28, 2012

Related U.S. Application Data

(60) Provisional application No. 61/219,064, filed on Jun. 22, 2009, provisional application No. 61/255,294, filed on Oct. 27, 2009.

(51) Int. Cl.
*B60P 7/06* (2006.01)

(52) U.S. Cl.
USPC ..... 410/46

(58) Field of Classification Search
USPC ..... 410/46, 77, 80, 81; 220/1.5
See application file for complete search history.

(56) References Cited

U.S. PATENT DOCUMENTS

| | | | |
|---|---|---|---|
| 3,296,981 | A | 1/1967 | Bergstrand |
| 5,641,082 | A | 6/1997 | Grainger |
| 6,059,130 | A | 5/2000 | Grainger |
| 6,863,003 | B2 | 3/2005 | Grainger |
| 7,140,502 | B2 | 11/2006 | Grainger |
| D623,821 | S | 9/2010 | Grainger |
| D623,822 | S | 9/2010 | Grainger |
| D625,529 | S | 10/2010 | Grainger |
| D639,448 | S | 6/2011 | Grainger |
| 8,016,370 | B2 | 9/2011 | Grainger |
| D647,684 | S | 10/2011 | Grainger |
| 2004/0007572 | A1 | 1/2004 | Payne |

FOREIGN PATENT DOCUMENTS

| | | | |
|---|---|---|---|
| CH | 554798 | A | 10/1974 |
| EP | 0139810 | A2 | 5/1985 |

*Primary Examiner* — H Gutman
(74) *Attorney, Agent, or Firm* — Charles A. Wilkinson; Clinton H. Wilkinson

(57) ABSTRACT

A support device (100) for carrying an inner load holder (50/60) in use within an outer transport and storage container (10). The device includes a base member (101, 102, 103, 105) for being secured or securable to a floor (16) of the outer container, having at least one formation (104) for restraining lateral movements of the inner load holder relative to the device in a plane generally parallel to the floor. The device further includes a mechanism (108) for releasably restraining said inner load holder in a direction perpendicular to said floor or base, wherein said mechanism includes at least one sliding bolt member (110) for selectively engaging with a complementary feature (62) of the inner load holder and when so engaged, providing said restraining.

21 Claims, 16 Drawing Sheets

Figure 1B:
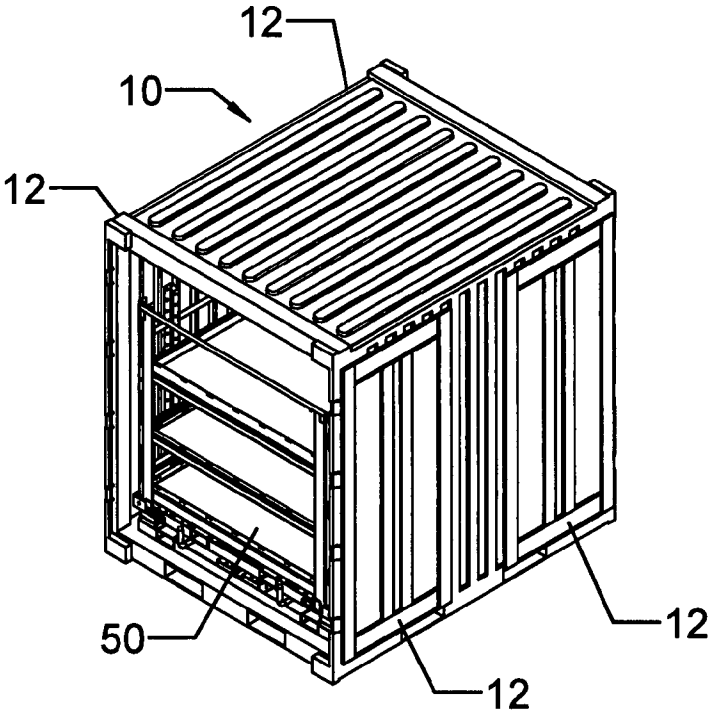

DETAIL C
LATCHED

DETAIL D
UNLATCHED

SECTION ON A-A
SECTION ON B-B
3B
A
B
C
D
10
12
14
16
50
60
62
100
110

100
105
108
104
114

101
102
103
110
112

UNLOCKED
LOCKED
Ax
L
UL
104
101
108
110
112
114
116
122
60
62

DETAIL H

DETAIL C

DETAIL F

DETAIL E

STORAGE AND TRANSPORTATION SYSTEM AND ELEMENTS THEREOF

This application is the national stage of PCT/GB2010/050702, filed Apr. 29, 2010, which claims priority from U.S. Provisional Patent Application Ser. No. 61/219,064, filed Jun. 22, 2009, and U.S. Provisional Patent Application Ser. No. 61/255,294, filed Oct. 27, 2009, the disclosures of which are incorporated herein by reference.

FIELD OF THE INVENTION

The present invention relates to a storage and transportation system and elements of that system.

BACKGROUND OF THE INVENTION

When items such as pallets are transported, they cannot necessarily rely on their own weight and that of the cargo that they carry to keep them fixed. They have to be constrained in some way. Traditionally, they have been lashed down by tensioned ropes, wires or chains, but those take time to set up and undo, and they are wasteful of space since there has to be room around the pallet. Also, the lashings are often directed over the cargo and so they compress the cargo. The loaded pallets are not easy to stack one on another.

To make stacking easier, pallet racks have been employed, but then the racks have to be restrained. Restraining cargo or items such as pallets can be even more problematic when the racks are on board moving aircraft and are subjected to considerable forces, e.g. 3-5 G. Usually, a large number of ropes, etc are required to tie the items in this situation, but this takes up a considerable amount of time and means that removing the pallets is also an awkward and time-consuming process. This is clearly disadvantageous when the contents need to be unloaded quickly in an emergency situation. Some parts, especially wheels on which the pallets can roll out that are not specially constructed to withstand the high forces can also bend, which can cause the pallet or the like to become stuck in the rack.

One attempt to overcome the problems mentioned is commercially available. In that product, transportation and storage equipment is used having elements including an outer container, a support device for fitting inside the container for removably holding a cargo or load rack. The rack and device are clamped together using a rotatable mechanism, which can be difficult to undo in use and requires regular maintenance and lubrication.

SUMMARY OF THE INVENTION

Embodiments of the present invention are intended to address at least some of the problems outlined above.

According to a first aspect of the invention there is provided a support device for carrying an inner load holder in use within an outer transport and storage container, said device including a base member for being secured or securable to the floor of the outer container, having at least one formation for restraining lateral movements of the inner load holder relative to the device in a plane generally parallel to the floor, said device further including a mechanism for releasably restraining said inner load holder in a direction perpendicular to said floor or base, wherein said mechanism includes at least one sliding bolt member for selectively engaging with a complementary feature of the inner load holder and when so engaged, providing said restraining.

Thus, in embodiments the inner load holder can be easily locked in position and unlocked by a simple and easily operable sliding mechanism.

In an embodiment the mechanism includes a shaft slideable, and at least partially rotatable about an axis, and the or each sliding bolt member includes a protrusion extending from the shaft having a portion which extends generally parallel with the shaft.

In an embodiment, the protrusion is a stepped member welded to the shaft.

Preferably the mechanism includes at least one shaft slideable in apertures in the base member and at least two protrusions on the or each shaft.

The protrusion may further comprise a fixing web.

Said at least one formation may include a plurality of recesses, for accepting complementary feet of the load holder.

Preferably said axis is above the lower extremity of the recesses.

Alternatively, said at least one formation may include a plurality of male protrusions, extending upwardly, and tapering upwardly, for complementary fitting into recesses on the inner load holder.

Said bolts, may be disengaged from said complementary features by sliding said shaft along said axis in a disengaging direction opposite to an engaging direction.

The support device may further comprise complementary formations for holding the bolts in an unlocked position when so disengaged.

Said bolts may be located in said further complementary formations by rotating said shaft when so disengaged and sliding said shaft when so rotated in the engaging direction, into engagement with the further complementary formations on the base member.

According to a second aspect of the present invention there is provided a storage system including:

A load holder for example in the form of an inner container, shelf or pallet configured, in use, to be fitted inside an outer container;

a supporting device for being secured within the outer container and being adapted to removably support the load holder within the outer container in use, the supporting device including a mechanism for slidingly engaging with the load holder, thereby releasably restraining relative movement between the inner container, shelf or pallet and the supporting device.

The mechanism may include comprise at least one sliding bolt arrangement and the load holder may include at least one corresponding formation, e.g. a hoop, with which the or each bolt arrangement engages in use.

The or each bolt arrangement may include a shaft with the at least one bolt arrangement fixed thereto. The shaft may be rotatable with respect to the supporting device. The at least one bolt arrangement may be configurable between a first configuration where it protrudes above a surface of the supporting device, and a second configuration where it lies away from the surface of the supporting device. In some embodiments, the shaft has a plurality of the bolt arrangements. At least one of the bolt arrangements may include a web to reinforce its connection to the shaft.

The supporting device may, in use, be fixed on a base or floor surface of the outer container by means of a fixing. Said fixing may include an isolator for electrolytically isolating the support device from the outer container. Said isolator may be in the form of a polymeric pad and/or plastics reinforced fastener. The supporting device may have an area dimensioned to correspond with a corresponding area of the base or floor surface, the supporting device thereby function as a replacement base or floor surface for the outer container. The supporting device may include at least one recess arranged to contain a foot or protrusion of the inner container, pallet or shelf.

BRIEF DESCRIPTION OF THE DRAWING FIGURES

Figure 1A:
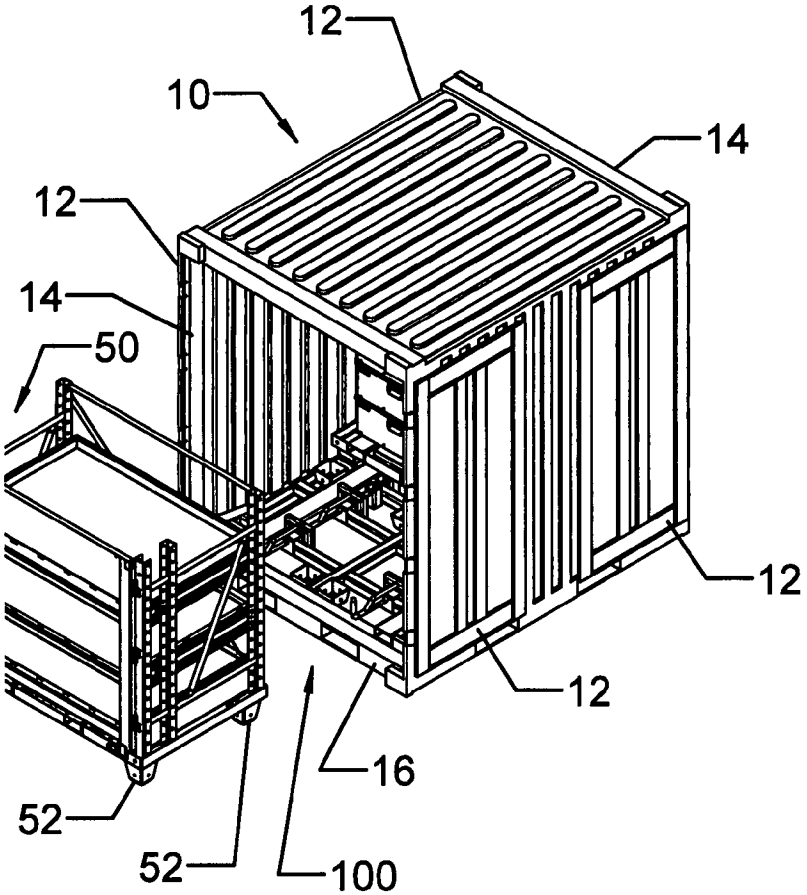

The invention extends to any novel feature described or illustrated herein, or any novel combination of features described or illustrated herein. Although the invention can be put into effect in numerous ways, illustrative embodiments only have been described below, with reference to the drawings wherein:

FIG. 1*a* shows one embodiment of a storage system according to the invention;

FIG. 1*b* shows the system shown in FIG. 1*a* in a different configuration;

FIGS. 2*a*, 2*b*, 2*c*, 2*d*, 2*e* and 2*f* show different views of the embodiment of FIGS. 1*a* and 1*b;*

Figure 3B:
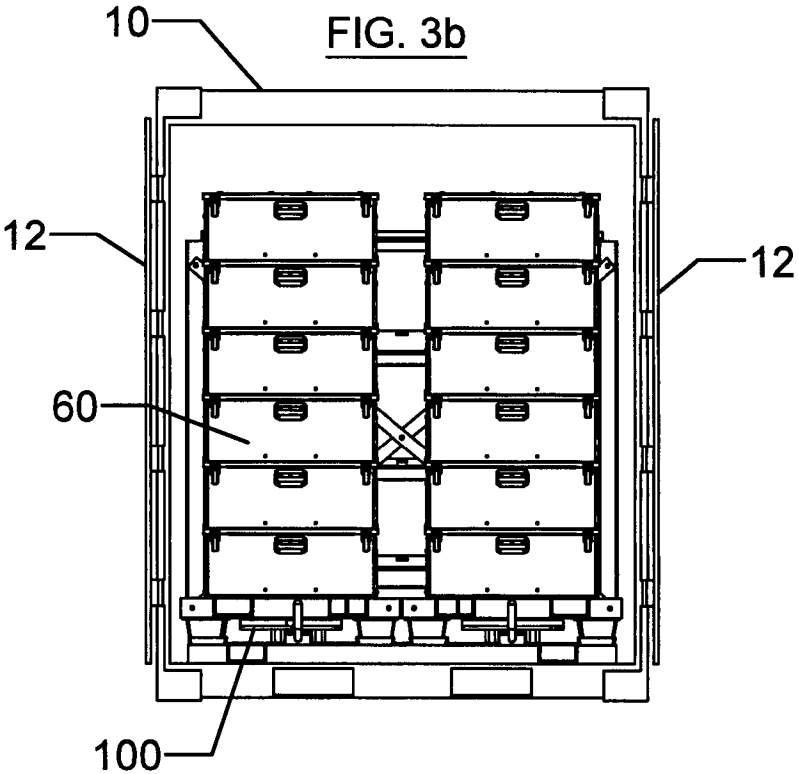
Figure 3A:
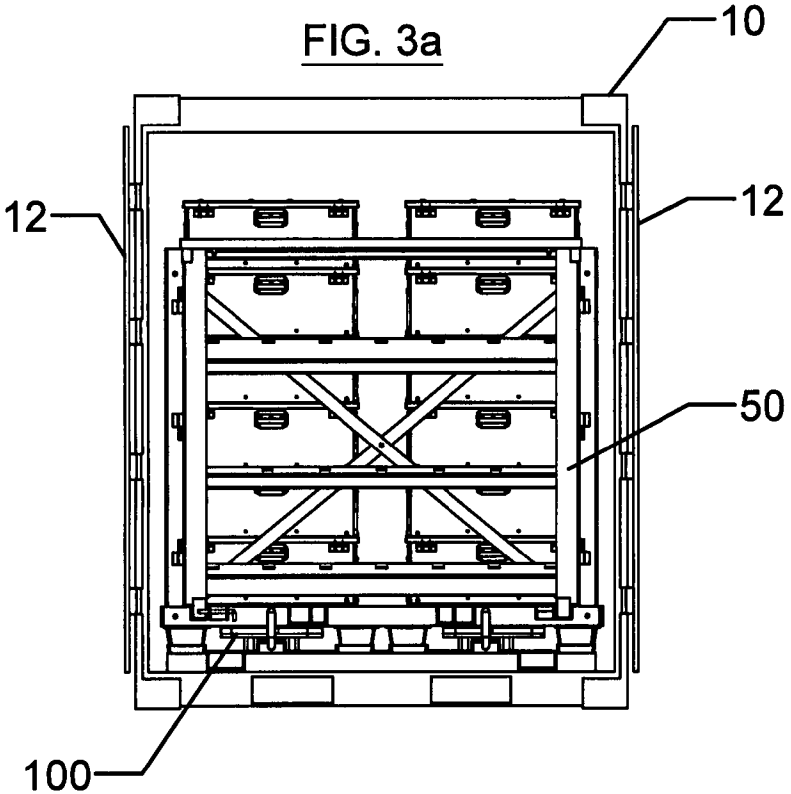

FIGS. 3*a* and 3*b* show further views of the embodiment shown in FIGS. 1*a* and 1*b;*

Figure 7B:
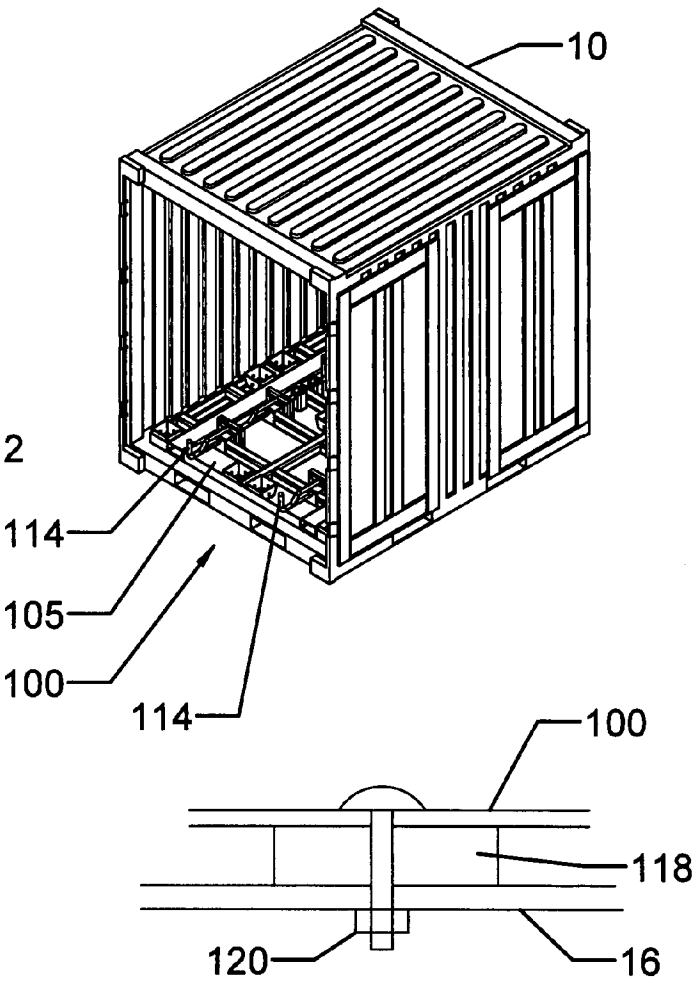
Figure 7A:
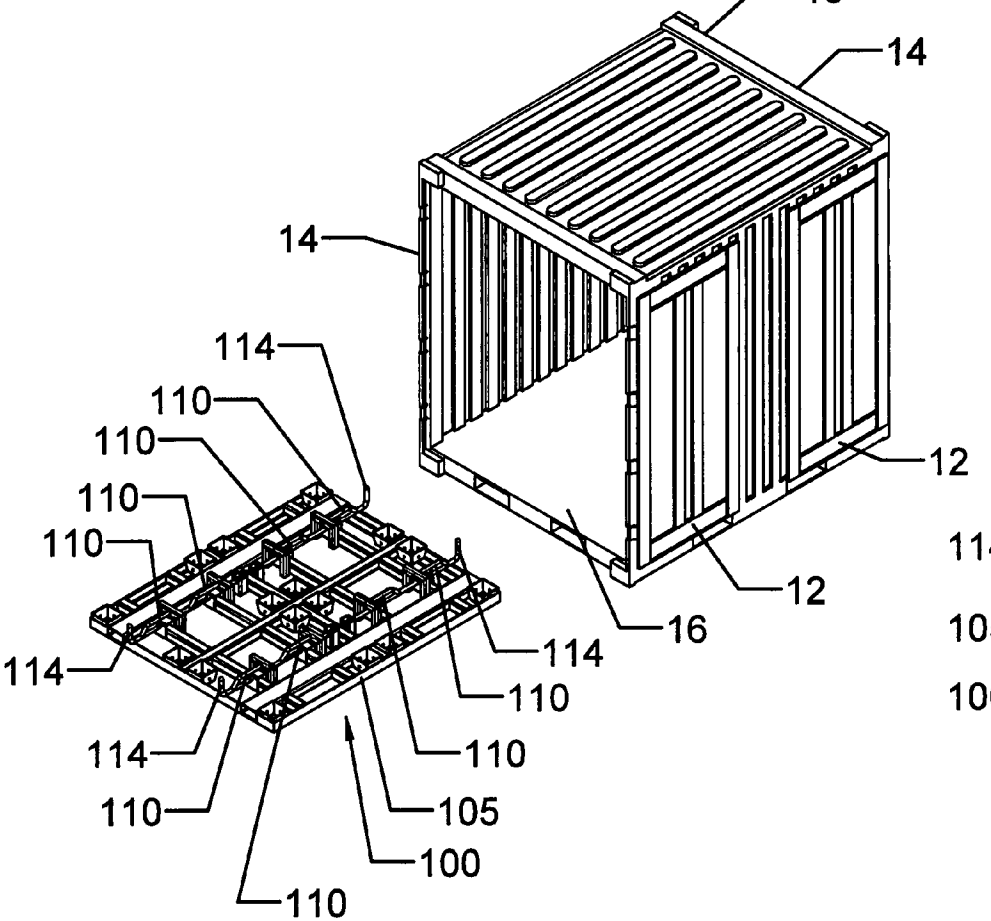
Figures 8A, 8B, 8C, 8D, 8E, 8F, 8G, 8H, 9:
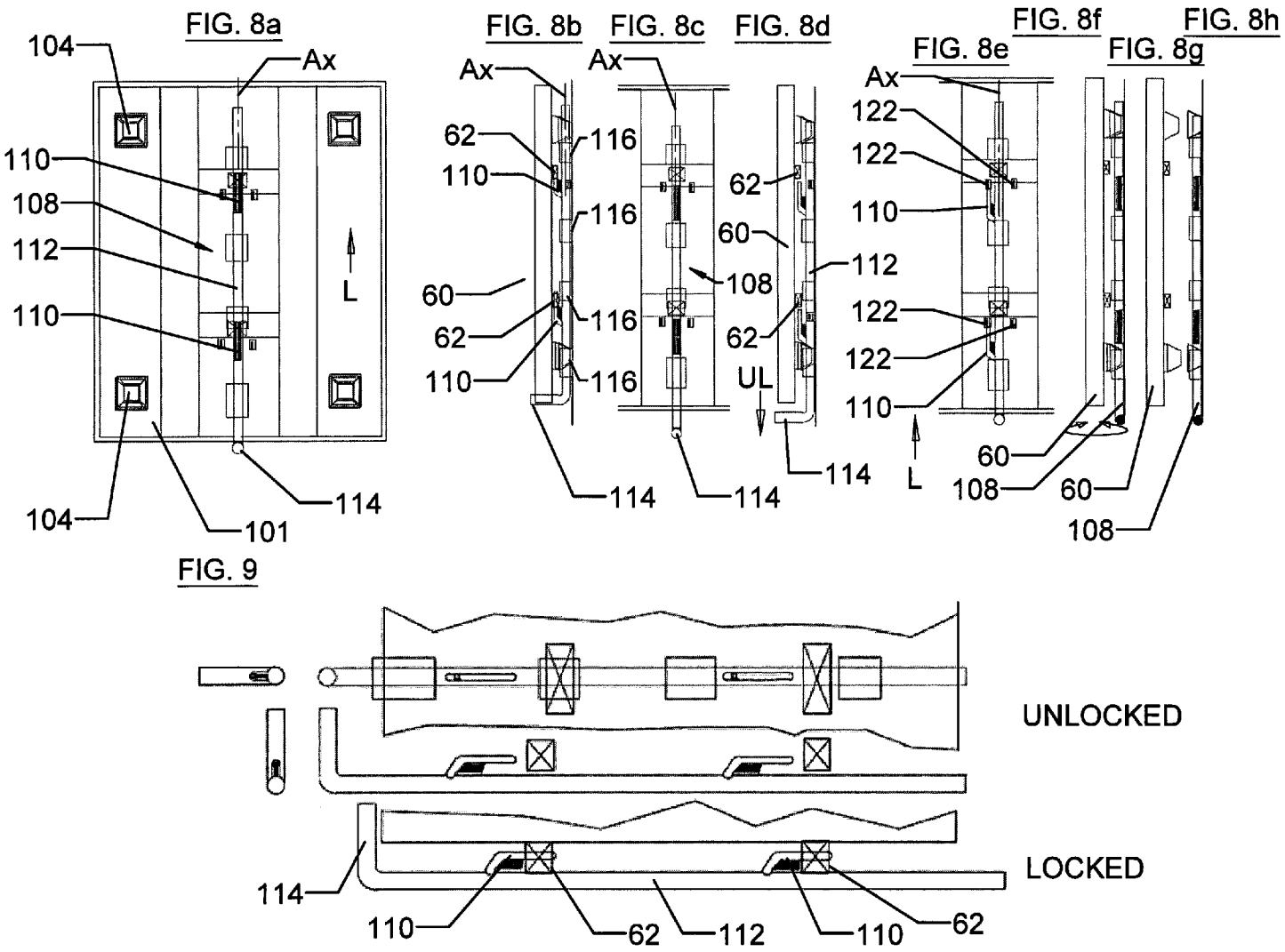

FIGS. 4*a*, 4*b*, 5*a*, 5*b* and 6 show different arrangements for one element of the system according to the invention;

FIGS. 7*a*, 7*b* and 7*c* show further elements of the system according to the invention;

FIGS. 8*a* through to 8*h* show details of the element shown in FIGS. 7*a* and 7*b;*

FIG. 9 shows further details of the elements shown in the previous drawings; and FIGS. 10*a* to 21*b* show another embodiment of the invention which is similar in construction to the embodiment shown in FIGS. 1 to 9.

DETAILED DESCRIPTION OF THE INVENTION

Referring to FIG. 1 there is shown an outer storage container 10 which has a generally standard size and is formed from pressed sheet metal components. The outer container 10 has two pairs of doors 12 which are closable to close opposite ends 14 of the container.

The outer container 10 has a floor 16 to which is secured a load-supporting device 100 only partially visible in this view. The load-supporting device 100 can releasably restrain cargo or load supporting elements, for example, load holders in the form of inner containers, shelves or pallets. In this embodiment shelves 50 are shown ready to be placed onto the load-supporting device 100. The shelves 50 have a plurality of tapered feet 52 which locate within complementary recesses in the support device 100. A similar load can be placed in the opposite open end of the outer container 10.

Referring to FIG. 1*b* the drawing shows the shelves 50 now placed within the outer container 10 ready for the doors 12 to be closed.

Figures 2A, 2B, 2C, 2D, 2E, 2F:
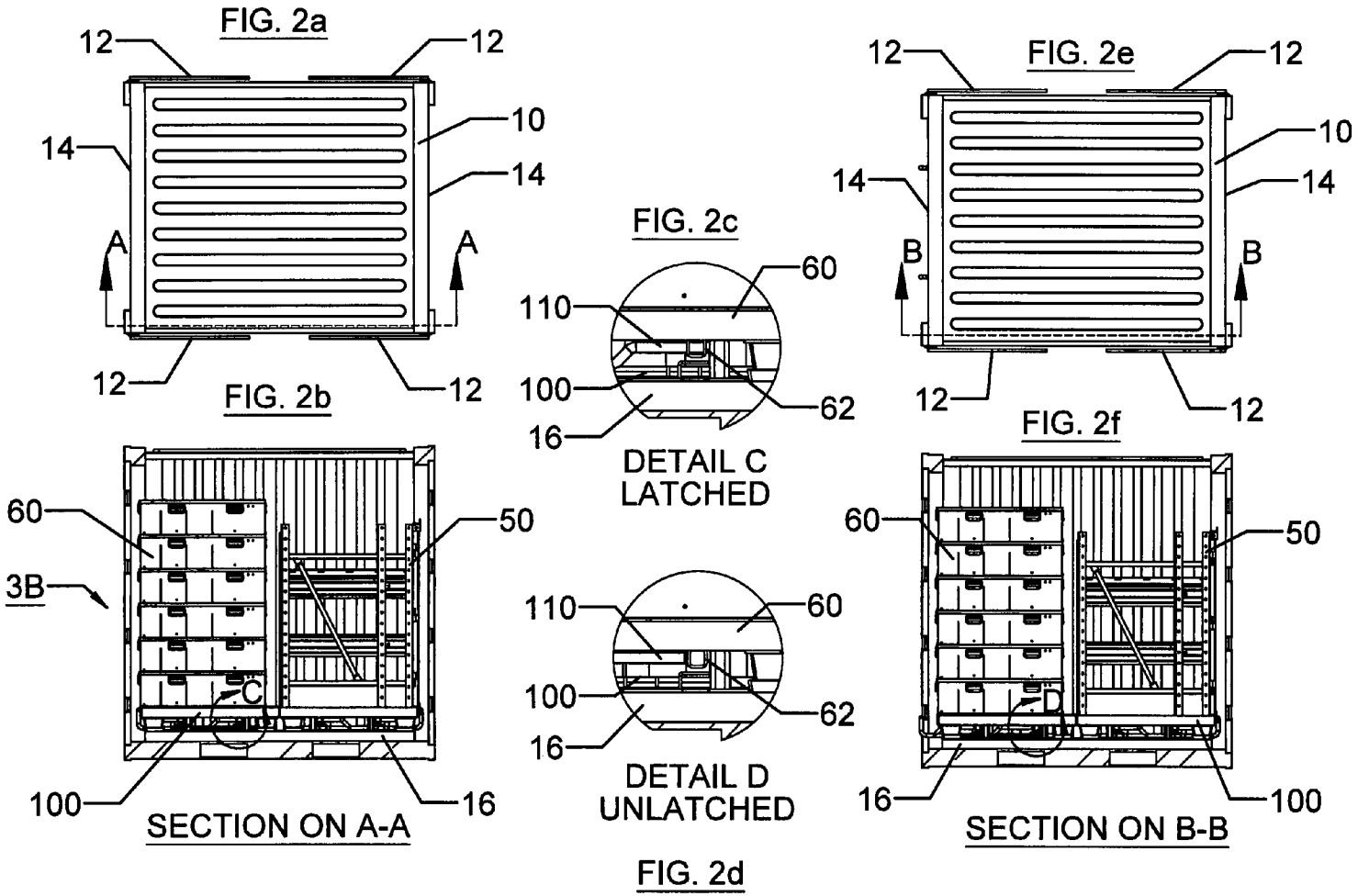

FIG. 2*a* shows a plan view of the outer container 10 showing the doors 12 swung fully open to expose the open ends 14.

FIG. 2*b* shows a section along line A-A in FIG. 2*a*. Shelves 50 are visible at one end 14 and at the other end a storage container 60 is loaded. Each load holder 50 and 60 is restrained on the support device 100 which is attached to the floor 16 of the outer container 10.

FIGS. 2*e* and 2*f* show similar views to FIGS. 2*a* and 2*b* respectively.

FIG. 2*c* shows details of the arrangement for restraining the load holder 50 and 60 within the outer container 10 on the support device 100. In this detail the support device 100 includes a slideable bolt 110 which, in this view, is engaged with a complementary formation 62 at a lower area of the inner container 60.

In FIG. 2*d* the same components are shown. However, the bolt 110 is withdrawn from the complementary formation 62 to allow the load holder 60 to be removed. It will be noted that a similar arrangement of locking bolt 110 can be used to restrain any load holder placed on the support device 100 as will be explained in more detail below.

FIG. 3*a* shows a view in the direction of arrow 3A in FIG. 2*b* and FIG. 3*b* shows a view in the direction of arrow 3B in FIG. 2*b*.

Figures 4A, 4B, 5A, 5B, 6:
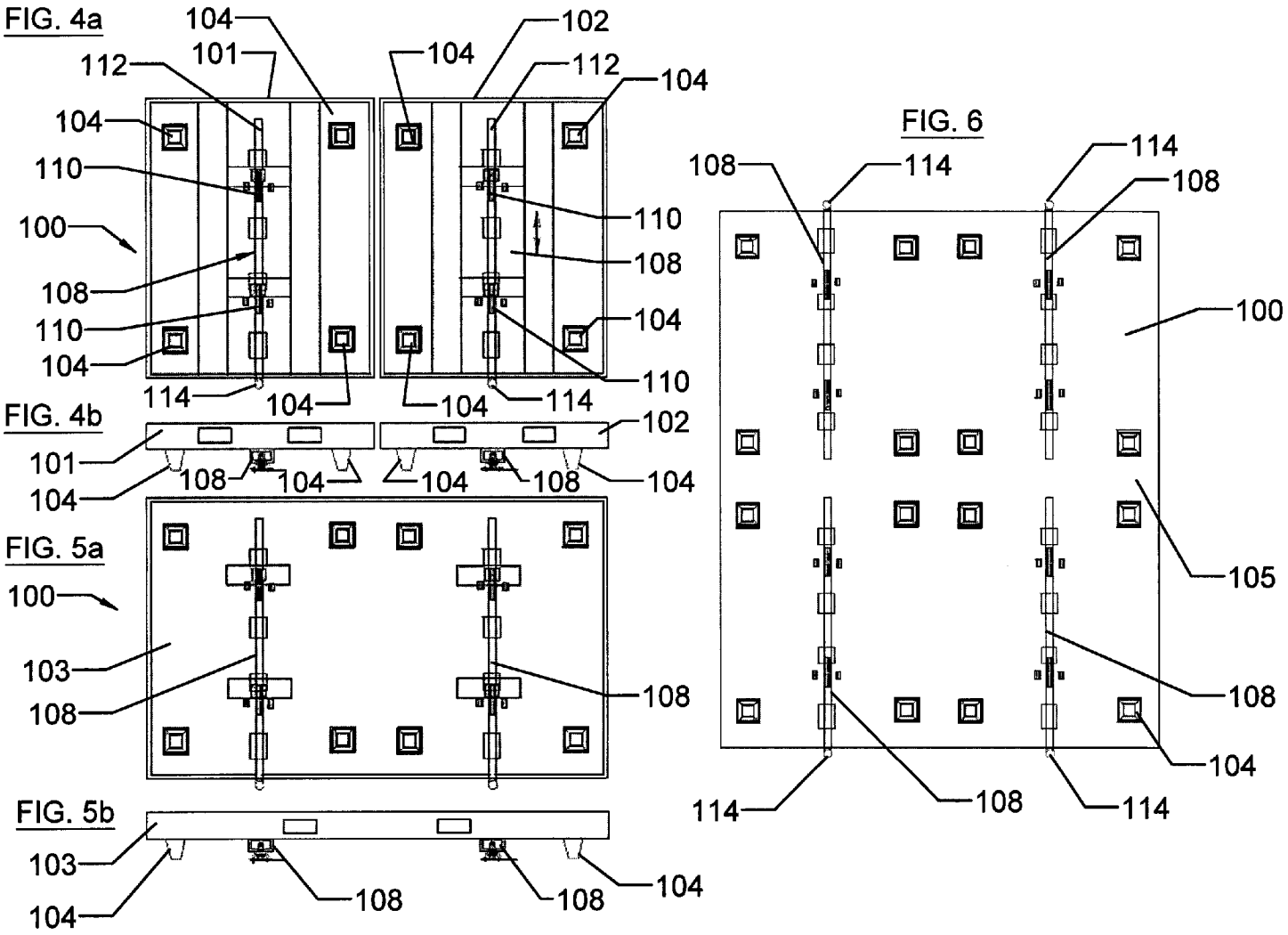

FIG. 4*a* shows a plan view of one arrangement of the support device 100 in more detail. The device 100 in this embodiment includes a pair 101 and 102 of base members which are identical. The base members each include four corner recesses 104 which taper inwardly for accepting the feet of load holders such as inner containers, shelves or pallets, for example feet 52. These recesses prevent lateral movement of the load in a plane parallel to the outer container floor 16. In order to prevent the feet from jumping out of the recesses 104 a mechanism 108 is provided. The mechanism includes the slideable bolts 110 mentioned above. In this case a shaft 112 supports a pair of bolts 110 which share the same movement axis. The shaft 112 also includes a handle 114 for manually moving the bolts 110. It is envisaged that two pairs of base members are used for each outer container 10.

FIG. 4*b* shows a side view of the pair of base members 101 and 102.

FIG. 5*a* shows a plan view of another support device 100, in this case the support device includes a single base member 103 which functions in the same manner as the support devices 100 shown in FIG. 4*a*. In particular, the support device 103 has the same arrangement of recesses 104 and the same pair of locking mechanisms 108.

FIG. 5*b* is a side view of the support device 103 shown in FIG. 5*a*.

FIG. 6 is a third version of the support device 100 having a large base member 105, which in effect is two of the base members 103 joined back to back, such that there are two pairs of locking mechanisms 108 which have handles 114 accessible from both ends 14 of the outer container 10. The base member 105 includes recesses 104, only one of which is referenced, which will restrain in use loads placed into an outer container 10 from both ends 14.

FIG. 7*a* shows the support device 100 having a base member 105 ready for fitting to the floor 16 of the outer container 10. As can be seen in this illustration the support device 100 when fitted will include four handles 114 each of which can be accessed one of the ends 14 of the container 10. The support device 100 includes four locking mechanisms 108, each of which has a pair of sliding bolts 110 operable by means of a handle 114.

FIG. 7*b* shows the support device 100 fitted into the outer container 10. It will be noted that the doors 12 will only close when the handles 114 are moved inwardly toward their locking position.

FIG. 7*c* shows a detail of the fixing of the support device 100 to the floor 16 of the outer container 10. The fixing includes an elastomeric pad 118 for example a polymeric material such as rubber or a synthetic polymer, and a plastics fiber reinforced bolt 120. This fixing help dampen shocks and vibration.

FIGS. 8*a* through to 8*h* show different views of the locking mechanism fitted to a support device 100. In this case the support device has base member 101 shown in FIG. 4*a*, although the same support device is used for the other bases shown in FIGS. 4*b*, 5*a*, 5*b* and 6. Returning to FIG. 8*a* the mechanism is shown in a locking position, having been moved along an axis AX in the direction of arrow L, by means of manual movement of handle 114.

FIG. 8*b* shows a side view of the base 101 shown in FIG. 8*a* together with part of the load holder 60 above it. In this view the bolts 110 can be seen as protrusions extending from the shaft and having portions which extend parallel to the shaft axis AX. It is those parallel portions which engage with hoops 62 on the load holder 60. Shaft 112 slides in journals 116 in the base 101.

Referring to FIG. 8*c* the locking mechanism 108 is shown in its unlocked position having been slid in the direction of arrow UL manually by means of movement of handle 114 along the axis AX. As can be seen from the side view of FIG. 8*c* illustrated in FIG. 8*d* when the handle and shaft 114 and 112 are moved in the direction of arrow UL they disengage from the hoops 62 allowing the load holder 60 to be removed from the support device 101.

Following disengagement, the mechanism can be left in a state of readiness for use, by rotating handle 114 about axis AX and moving the handle in the direction of arrow L so that the bolts 110 engage with complementary receivers 122 in the base 101 which act to hold the shaft 112 in a restrained position, allowing the positioning of a load holder on the support device 101 prior to locking.

FIGS. 8*f*, 8*g* and 8*h* show use of the mechanism 108 and load holder 60 as the load is removed from the mechanism following positioning of the mechanism as shown in FIG. 8*e*.

FIG. 9 shows further views of details of the mechanism 108 in locked and unlocked positions.

Figure 10B:
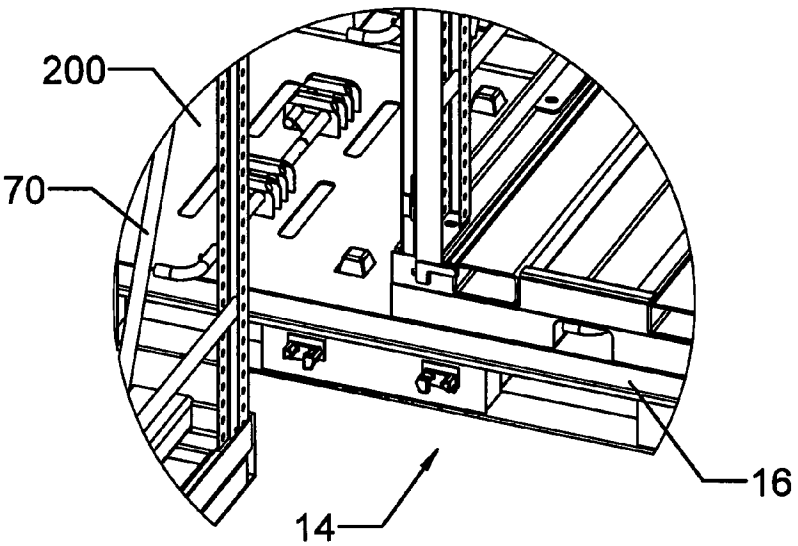
Figure 10A:
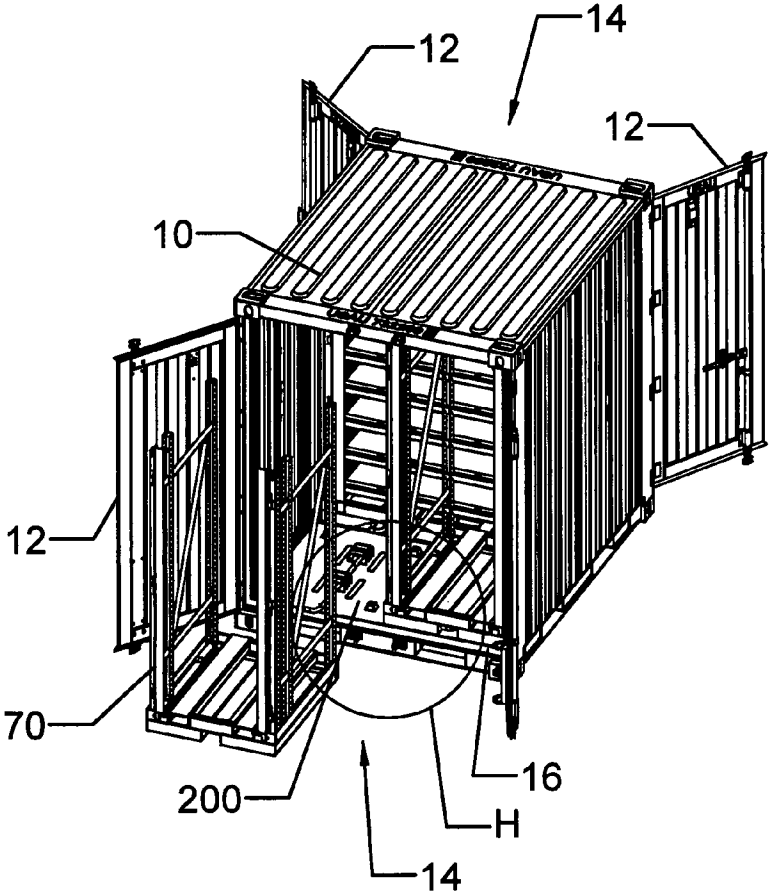

Referring to FIG. 10*a* there is shown a further embodiment of the invention, where like referenced numerals indicate features similar to the features described above. In this embodiment the container 10, again has two pairs of doors 12, openable to expose two container ends 14. The floor 16 of the container 10 includes a load supporting device 200, which is a modified version of the load supporting device 100 described above. The load support device 200 is used to support and secure load holders such as the racking 70 illustrated in FIG. 10*a*.

FIG. 10*b* shows an enlarged detailed view of a portion of the illustration shown in FIG. 10*a*. In this view, the floor 16 of the container 10 is visible having welded thereto the load support device 200, which can support and restrain, in this instance, the load holding racking 70, which in turn is used to support loads to be carried within the container 10.

Figure 11:
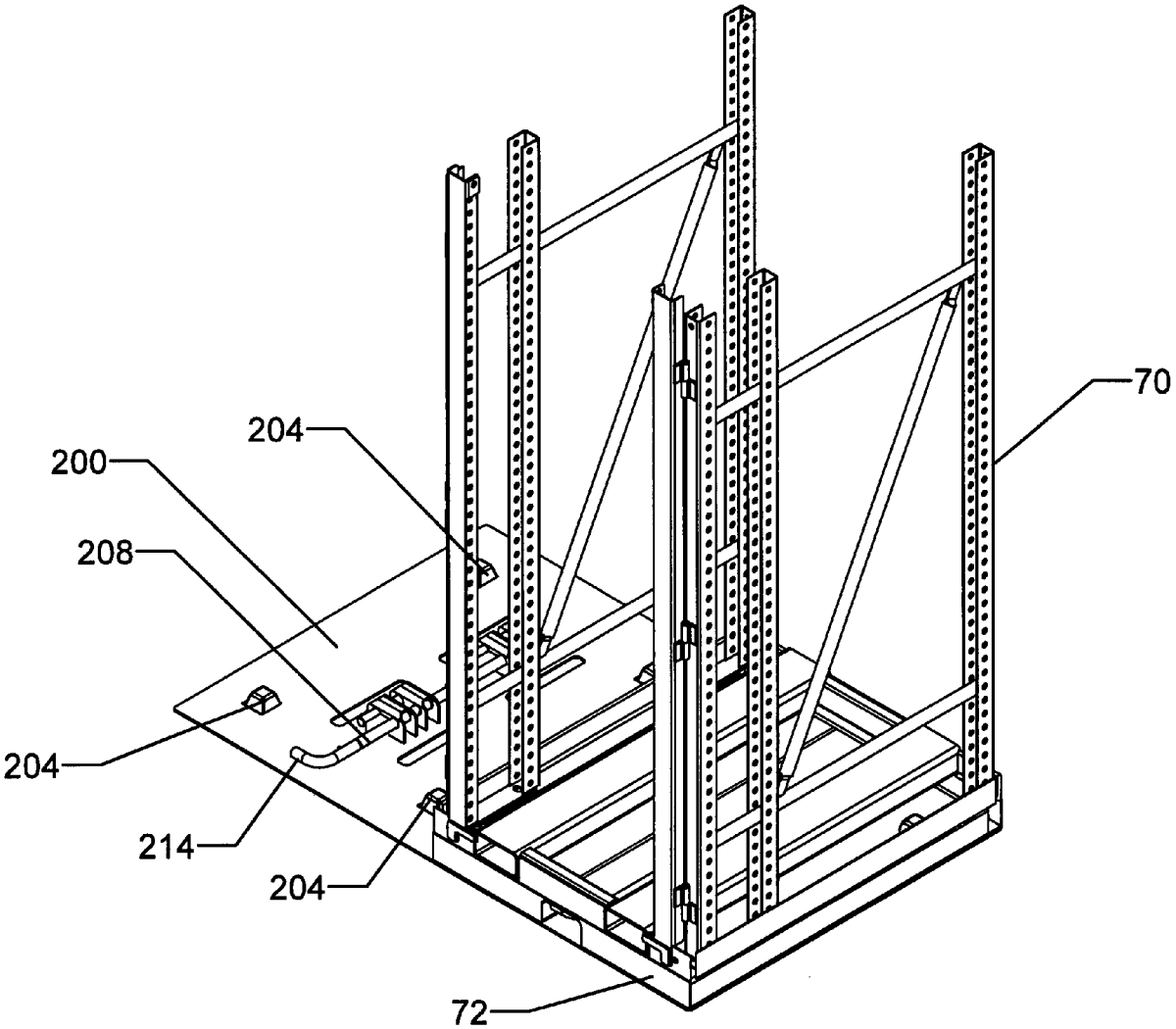

FIG. 11 shows the load holder 70 in more detail. Further the load holder 70 has a base 72 which has complementary formations for fitting to the support device 200. The support device 200, in turn, has features, which will be described in more detail below for securing the load holder 70 in place, or any other load holder having the appropriate complementary features. The features for securing the load holder 70 include upstanding male protrusions 204, and a bolt 208 which includes a sliding handle 214. The features mentioned immediately above will be described in more detail below.

Figure 12B:
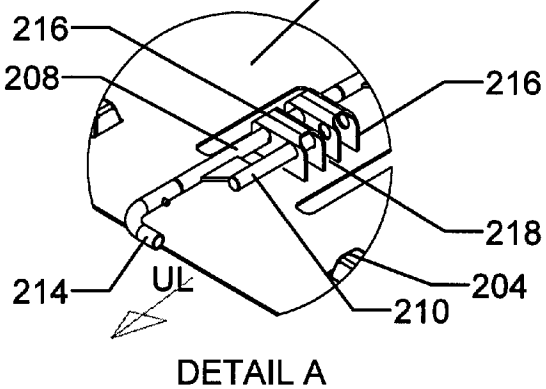
Figure 12A:
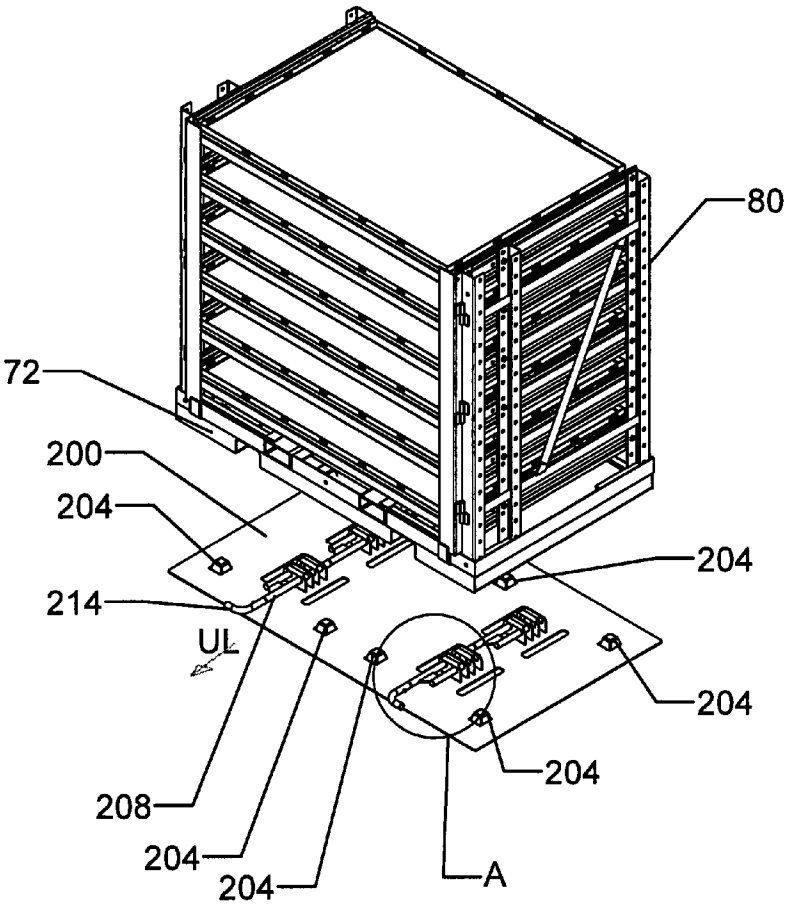

FIG. 12*a* shows an alternative load holder 80 suspended above the load support 200. In practice the load support 200 will be welded or otherwise secured to the base 16 of the container 10 mentioned above. Load holder 80, in this case comprises a series of shelves for supporting a load and includes a base 72 suitable for fixing to the load support 200. In this view, the locking bolt 208 has been slid in the direction of arrow U.L, so that complementary formations on the load holder 80 can be offered into the area 218 formed between two channel members 216 secured to the support device 200. It will be noted that the securing bolt 208 includes a locking bar 210 which does not protrude substantially into the area 218 when the bolt 208 is slid in the direction of arrow U.L.

Figure 13B:
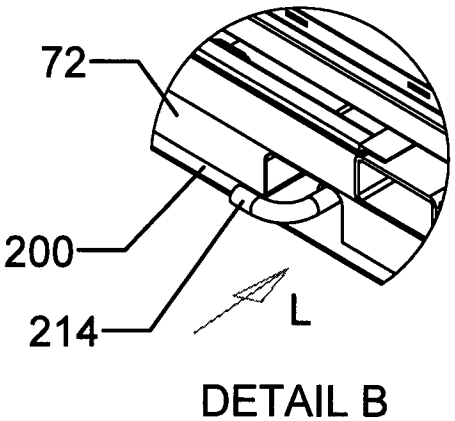
Figure 13A:
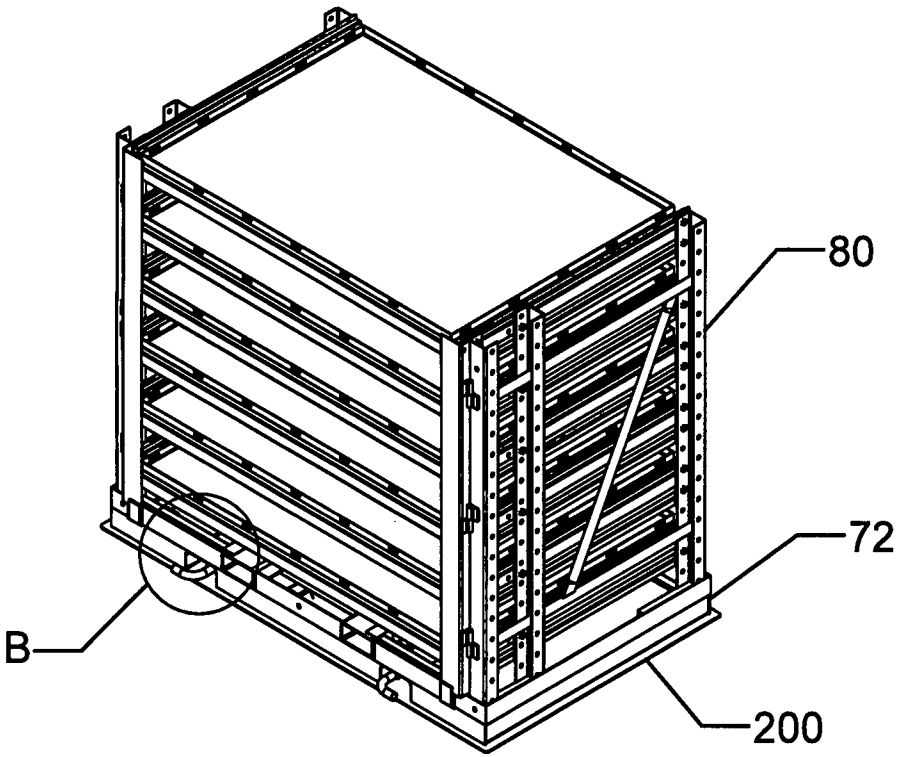

Referring to FIGS. 13*a* and 13*b* these illustrations show the load holder 80 lowered on to the support device 200, such that the base 72 of the load holder 80 engages with the support device 200. It is then necessary to manually slide the bolt 208 in the direction of arrow L shown in FIG. 13*b* such that the retaining bar 210 is consequently pushed into the area 218, as shown in FIG. 12*b*. The complementary formations on the base 72, which will be described in more detail below, are thus held in position when the locking bolt 208 is in the locked position.

Figure 14B:
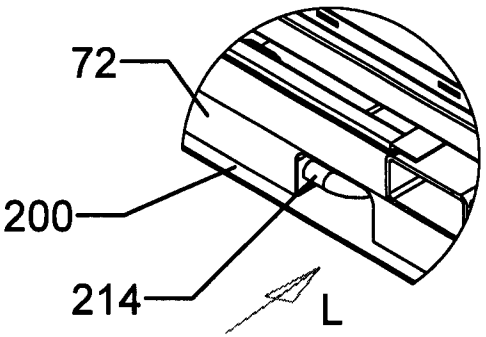
Figure 14A:
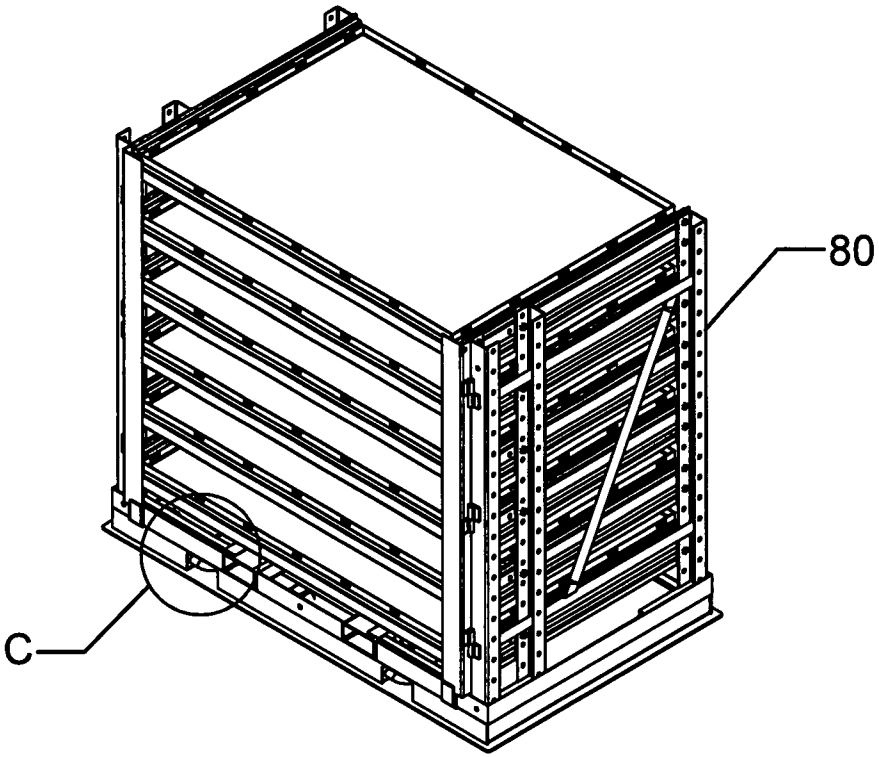

Referring to FIGS. 14*a* and 14*b* the handle portion 214 of the locking bolt 208 is shown in the locked, home, position.

Figure 15:
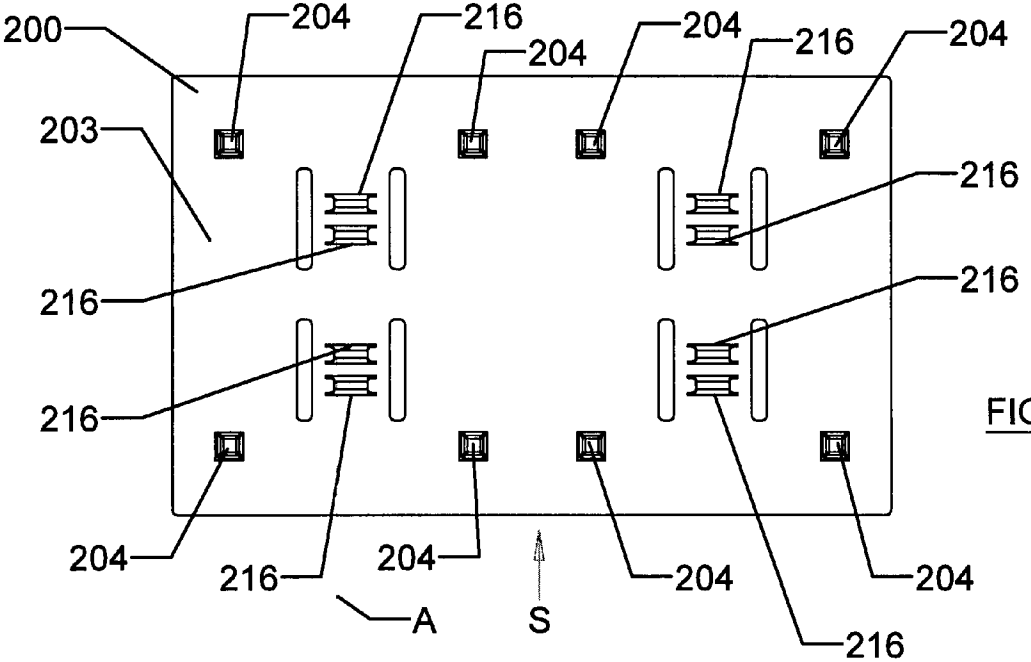

FIG. 15 shows a plan view of the support device 200. The device includes a sheet metal plate 203 to which are welded 8 upstanding male protrusions 204. These protrusions taper upwardly and accept complementary formations formed on the base 72. The support device 200 includes also the upstanding channel members 216, formed in pairs, which also act to guide the sliding bolt 208.

Figure 16:
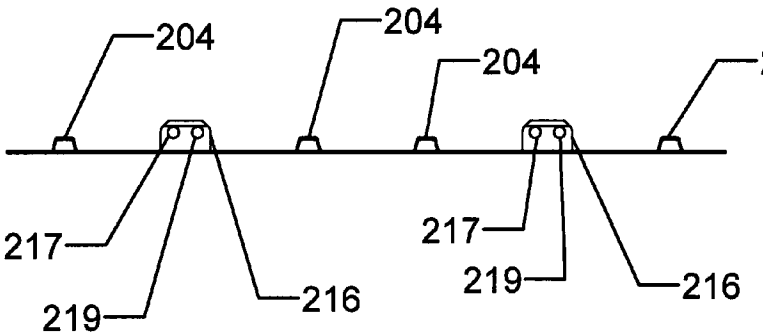

FIG. 16 shows a side view of the support device 200 in the direction of arrow S in FIG. 15. In this view the upwardly tapering shape of the male protrusions 204 are more clearly visible. In addition, the channel members 216 can be shown having two apertures 217 and 219. The apertures 217 and 219 in each channel member 216 are formed to align, for example alignment along axis A in FIG. 15.

Figure 17B:
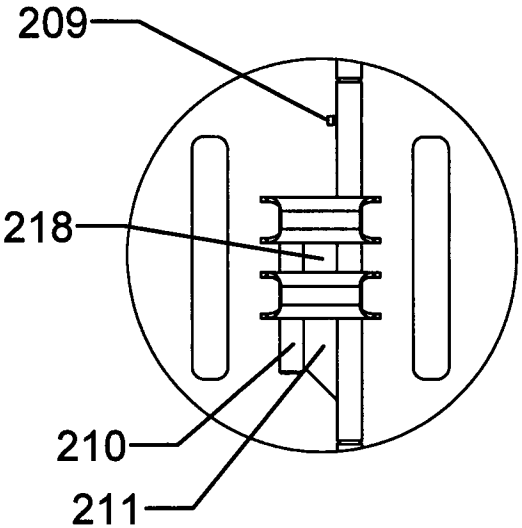
Figure 17A:
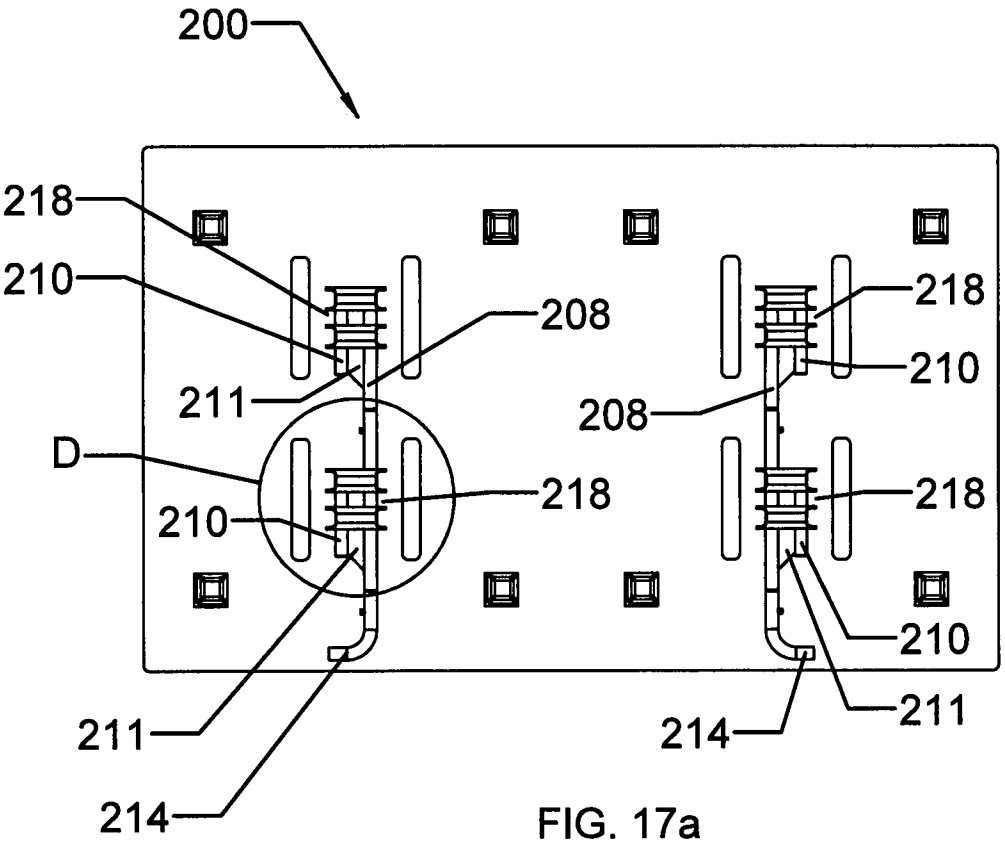

FIGS. 17*a* and 17*b* show the support device 200 including a pair of bolts 208 fitted into place. The bolts are formed in pieces and joined together using grub screws 209 shown in FIG. 17*b*. This allows the channel sections 216 shown in FIG. 16 to be welded to the plate 203 before the sliding bolts 208 are fitted into the apertures 217 and 219. The sliding bolts 208 are shown in their locked position, i.e. with the retaining bars 210 engaged fully within the areas 218 formed between adjacent channel members 216.

Figure 18:
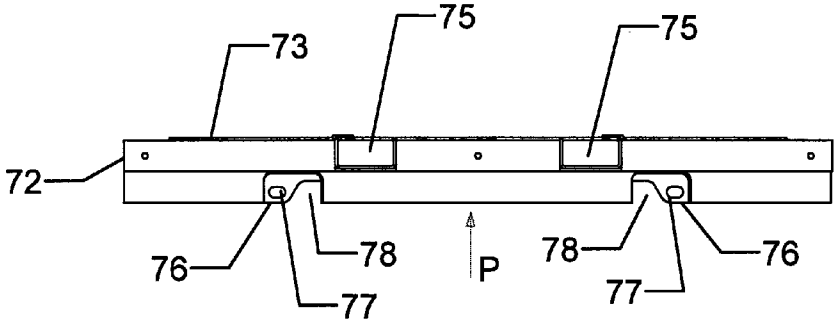

FIG. 18 shows a side view of a base member 72 which is suitable for attaching to the support device 200 shown in FIG. 17*a*. The base member includes a frame 73 which has parallel passages 75 for accepting the forks of forklift truck or the like. In addition the frame includes four complementary formations 76 which, when in position on the support device 200, sit in the area 218 formed between two adjacent channel members 216. The complementary formations 76 each include also an aperture 77 into which is slideable a retaining bar 210, when in position. Additionally, the complementary formations 76 include wasted regions 78 which provide clearance for the sliding bolt 208.

Figure 19:
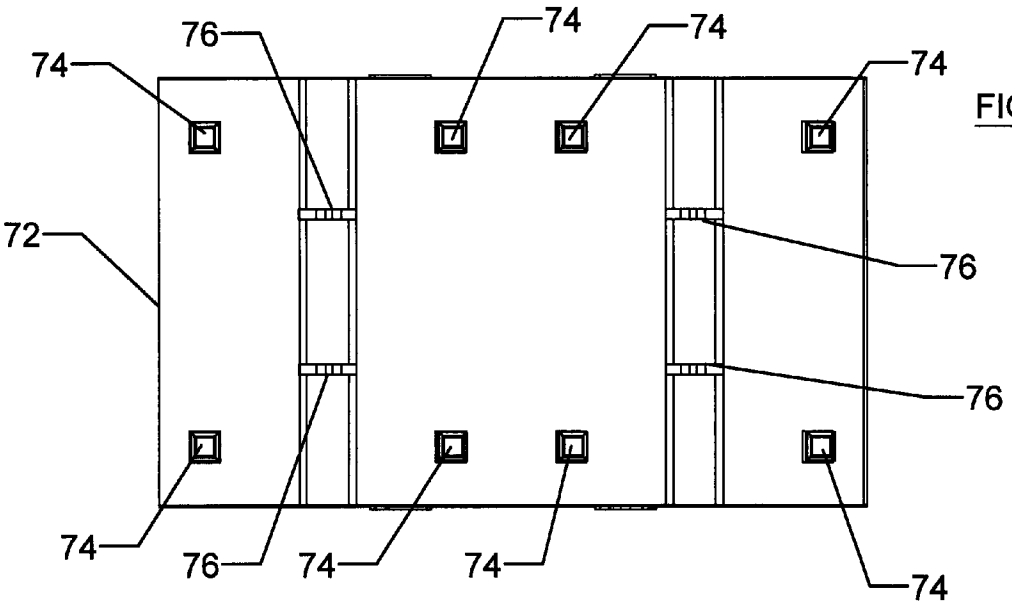

FIG. 19 shows a view of the underside of the base member 72 in the direction of arrow P in FIG. 18. In this view the female tapered recesses 74 are visible for accepting the male protrusions 204, and thus restraining the lateral movement of the base member 72 relative to the support device 200. Additionally, the four complementary formations 76 are visible spaced so that each of those formations will fall into each of the areas 218 shown in FIG. 17*a*.

Figure 20B:
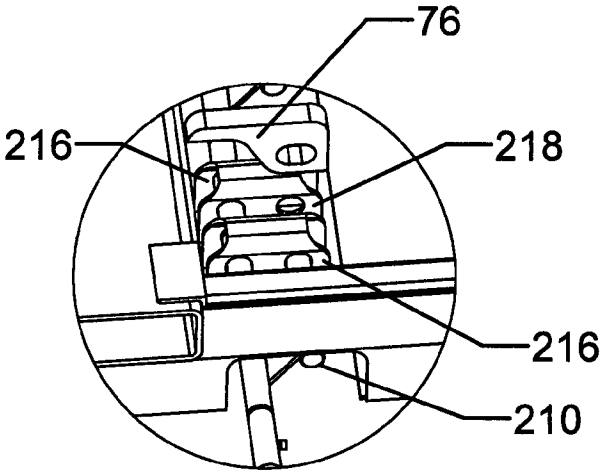
Figure 20A:
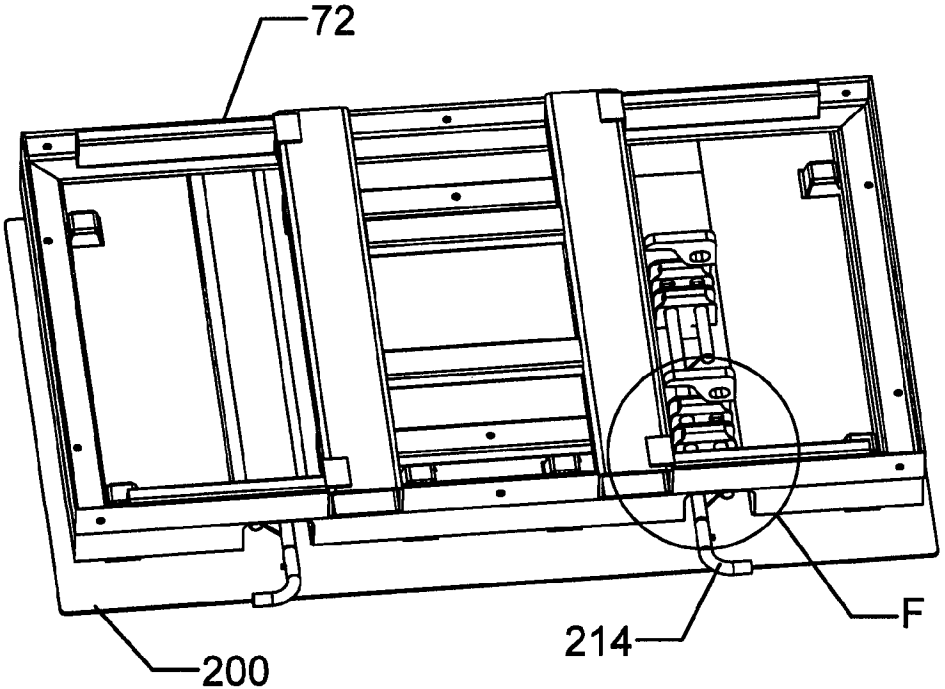
Figure 21B:
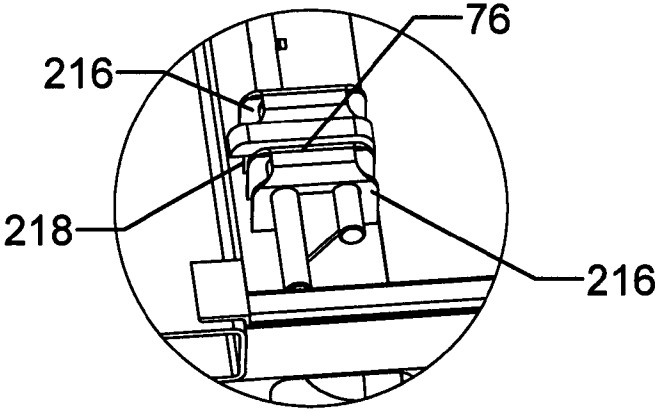
Figure 21A:
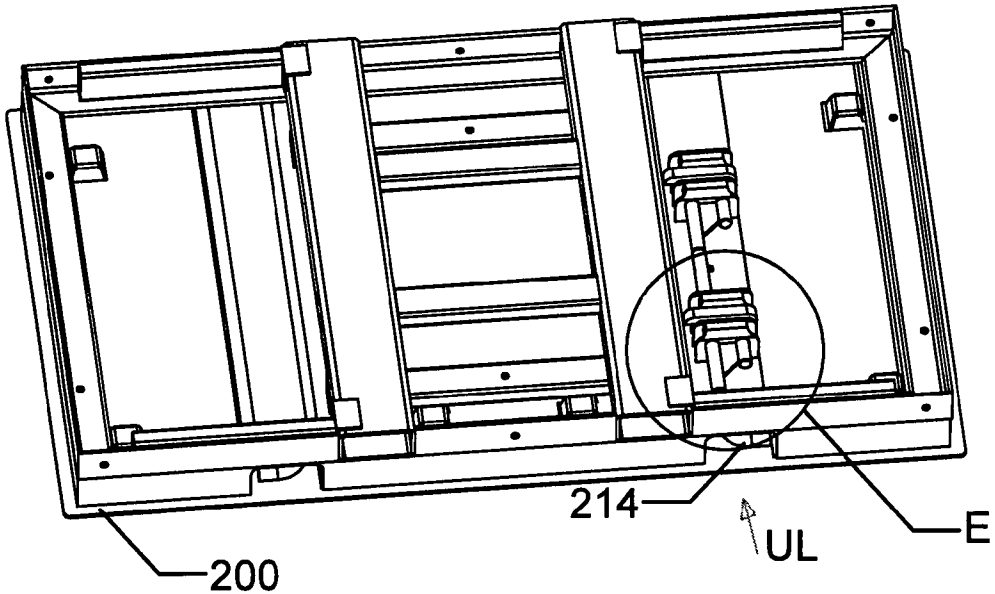

FIG. 20*a* shows a cut-away view of the base member 72 in position over the support device 200. FIG. 20*b* shows in detail the complementary formation 76 hovering above the channel members 216, with the retaining bar 210 withdrawn from the locating area 218.

FIGS. 20*a* and 20*b* show the base member 72 locked in position on the support device 200. In this Figure the handle 214 has been pushed in the direction of arrow U.L. following the lowering of the complementary formations 76 into the locating areas 218. It will be noted that the aperture 77 in the complementary formation 76 is elongated in a direction perpendicular to the axis A of the sliding of the retaining bar 210, to allow for any misalignment between the securing bar 210 and the base member 72. In addition it will be noted that the doors 12 shown in FIG. 10 cannot be closed until the handles 214 are pushed into their locking positions, such that the load holders 70 or 80 (or other load holders mounted to the base member 72), has to be locked into position before the doors 12 can be closed.

In the FIGS. 10 to 21 a pair of locking bolts 208 are illustrated each for use with a pair of retaining bars 210. However, other combinations of locking bolts could be employed, including a single locking bolt or multiple locking bolts. In addition, the number and position of the male protruding members 204 and their corresponding female recesses 74 can be varied.

Thus, for each embodiment described above, a simple sliding mechanism can be used to lock various load holders 50, 60,70 or 80 or other containers, shelves, racks or pallets in position. Straightforward unlocking of the load can be achieved by sliding the shaft 112, 208 into its unlocking position as mentioned above. In the embodiments, at least two bolts per support device have been illustrated. Although one bolt would suffice, two is preferred to provide two locking points and thus reduce the chance of the load holder rocking.

Embodiments only of the invention have been described above, but it will be apparent to the skilled addressee that other variants, modifications or alternatives could be used without departing from the spirit or scope of the invention.

The invention claimed is:

1. A support device (100) for carrying an inner load holder (50/60) in use within an outer transport and storage container (10), said device including a base member (101, 102,103,105) for being secured or securable to a floor (16) of the outer container (10), having at least one formation (104) for restraining lateral movements of the inner load holder (50/60) relative to the device (100) in a plane generally parallel to the floor, said device (100) further including a mechanism (108) for releasably restraining said inner load holder (50/60) in a direction perpendicular to said floor or base, wherein said mechanism includes at least one sliding bolt member (110) for selectively engaging with a complementary feature (62) of the inner load holder and when so engaged, providing said restraining, the device characterised in that the mechanism (108) includes a shaft (112) that is slideable, and at least partially rotatable about an axis, and the at least one sliding bolt member (110) includes a protrusion (210) extending from the shaft having a portion which extends generally parallel with the shaft.

2. A device according to claim 1, wherein the protrusion is a stepped member welded to the shaft.

3. A device according to claim 1, wherein the shaft is slideable in apertures in the base member (101,102,103,105) and includes at least two protrusions (210) on the or each shaft.

4. A device according to claim 3, wherein a said protrusion further comprises a fixing web (211).

5. A device according to claim 3, wherein said at least one formation (104) includes a plurality of recesses for accepting complementary feet of the load holder.

6. A device according to claim 5, wherein the axis is above a lower extremity of the recesses.

7. A device according to claim 1, wherein said at least one formation includes a plurality of male protrusions (204), extending upwardly, and tapering upwardly, for complementary fitting into recesses on the inner load holder (50/06).

8. A device according to claim 1, where, in use, the at least one bolt is disengaged from the complementary feature by sliding the shaft along the axis in a disengaging direction opposite to an engaging direction.

9. A device according to claim 8, wherein the support device (100) further comprises complementary formations (216) for holding the at least one bolt in an unlocked position when disengaged.

10. A device according to claim 9, wherein the at least one bolt is located in said further complementary formations by rotating said shaft when so disengaged and sliding said shaft when so rotated in the engaging direction, into engagement with the further complementary formations on the base member.

11. A storage system including: a load holder in a form of an inner container, shelf or pallet (50/60) configured, in use, to be fitted inside an outer container (10); a supporting device (100) for being secured within the outer container and being adapted to removably support the load holder (50/60) within the outer container in use, the supporting device (100) including a mechanism (108) for slidingly engaging with the load holder (50/60), thereby releasably restraining relative movement between the inner container, shelf or pallet and the supporting device; wherein the mechanism (108) includes a shaft (112) that is slideable, and at least partially rotatable about an axis, and at least one sliding bolt arrangement (110) including a protrusion (210) extending from the shaft having a portion which extends generally parallel with the shaft, and the load holder includes at least one corresponding formation (62) with which the or each bolt arrangement engages in use.

12. A system according to claim 11, wherein the or each bolt arrangement is fixed to the shaft.

13. A system according to claim 12, wherein the shaft is rotatable with respect to the supporting device.

14. A system according to claim 13, wherein the at least one bolt arrangement (110) is configurable between a first configuration where it protrudes above a surface of the supporting device, and a second configuration where it lies away from the surface of the supporting device.

15. A system according to claim 11, wherein the shaft has a plurality of the bolt arrangements.

16. A system according to claim 11, wherein at least one of the bolt arrangements includes a web (211) to reinforce its connection to the shaft (112).

17. A system according to claim 11, wherein the supporting device is, in use, fixed on a base or floor surface of the outer container (10) by means of a fixing (120).

18. A system according to claim 17, wherein said fixing includes an isolator (118) for electrolytically isolating the support device from the outer container.

19. A system according to claim 18, wherein said isolator is in the form of at least one of a polymeric pad and plastics reinforced fastener.

20. A system according to claim 19, wherein the supporting device (100) has an area dimensioned to correspond with a corresponding area of the base or floor surface (16), the supporting device thereby functioning as a replacement base or floor surface for the outer container (10).

21. A system according to claim 20, wherein the supporting device includes at least one recess (104) or tapered male member (204) arranged to contain a foot or protrusion of the inner container, pallet or shelf.

* * * * *